United States Patent [19]

Koetsch et al.

[11] 3,986,101

[45] Oct. 12, 1976

[54] AUTOMATIC V-I CROSSOVER REGULATOR

[75] Inventors: Philip W. Koetsch; Joseph C. Jensen, both of San Diego, Calif.

[73] Assignee: NCR Corporation, Dayton, Ohio

[22] Filed: Mar. 10, 1975

[21] Appl. No.: 556,839

[52] U.S. Cl. ..... 323/20; 323/4; 307/82

[51] Int. Cl.[2] ..... G05F 1/56

[58] Field of Search ..... 323/4, 20, 21, 22 T, 323/DIG. 1; 307/52, 53, 58, 60, 82

[56] References Cited

UNITED STATES PATENTS

| | | | |
|---|---|---|---|
| 3,303,411 | 2/1967 | Gately | 323/20 X |
| 3,602,804 | 8/1971 | Randall | 323/21 |
| 3,694,662 | 9/1972 | Grygera et al. | 323/20 X |
| 3,796,919 | 3/1974 | Johnson | 323/20 X |
| 3,836,839 | 9/1974 | Becky | 323/20 |

FOREIGN PATENTS OR APPLICATIONS

| | | | |
|---|---|---|---|
| 1,181,350 | 2/1970 | United Kingdom | 323/DIG. 1 |

*Primary Examiner*—Gerald Goldberg
*Attorney, Agent, or Firm*—J. T. Cavender; James H. Phillips

[57] ABSTRACT

In order to achieve the capability to operate a plurality of identical power supplies in parallel, whereby the drawbacks of the conventional master-slave regulator relationship are avoided, the regulator of each power supply is provided with a load current sensor and a secondary differential amplifier circuit responsive to a predetermined load current for controlling the normal reference voltage supplied to the primary, voltage regulating differential amplifier. As a result of the inevitable, within-tolerance differences in the characteristics of two paralleled regulators, one supply will assume constant current operation at the predetermined load current while the other supply will operate at constant voltage and will carry the remainder of the actual load current. As many identical power supplies as necessary for a given application may be operated in parallel, and a single one will automatically operate in the constant voltage mode while the rest operate in the constant current mode.

5 Claims, 2 Drawing Figures

AUTOMATIC V-I CROSSOVER REGULATOR

BACKGROUND OF THE INVENTION

This invention relates to the regulated power supply art and, more particularly, to the aspect of the art in which a plurality of power supplies are operated in parallel to obtain a predetermined current capacity.

According to the prior art, when a plurality of similar power supplies are disposed in parallel, it has been necessary to establish a master-slave relationship between their respective regulators. The master supply operates in a completely normal fashion and may be set up for either constant voltage or constant current as required. The slave supply employs its regulator circuit to compare the voltage drop across the current monitoring resistor of the master supply with the voltage drop across the current monitoring resistor of the slave supply. The slave regulator adjusts the conduction of the series regulator in the slave supply so that the IR drops across the two current monitoring resistors are held equal. Therefore, assuming equal values of current monitoring resistors in the master and slave supplies, the output current contribution will always be equal regardless of the output voltage or current requirement of the load.

Those skilled in the art will understand that the regulators associated with master and slave supplies must physically differ and will recognize the advantages that would accrue from the realization of a power supply which can be disposed in parallel with one or more identical supplies. No internal changes would be necessary to convert a supply to the slave configuration nor would dedicated external wiring have to be provided. Capability for expansion of the power supply systems to a higher current capacity would be greatly simplified.

It is therefore a broad object of our invention to provide an improved regulated power supply system.

It is another object of our invention to provide such an improved system in which a plurality of power supplies are employed.

It is a more specific object of our invention to provide such an improved system in which all the power supplies are identical.

DETAILED DESCRIPTION OF THE INVENTION

Figure 1:
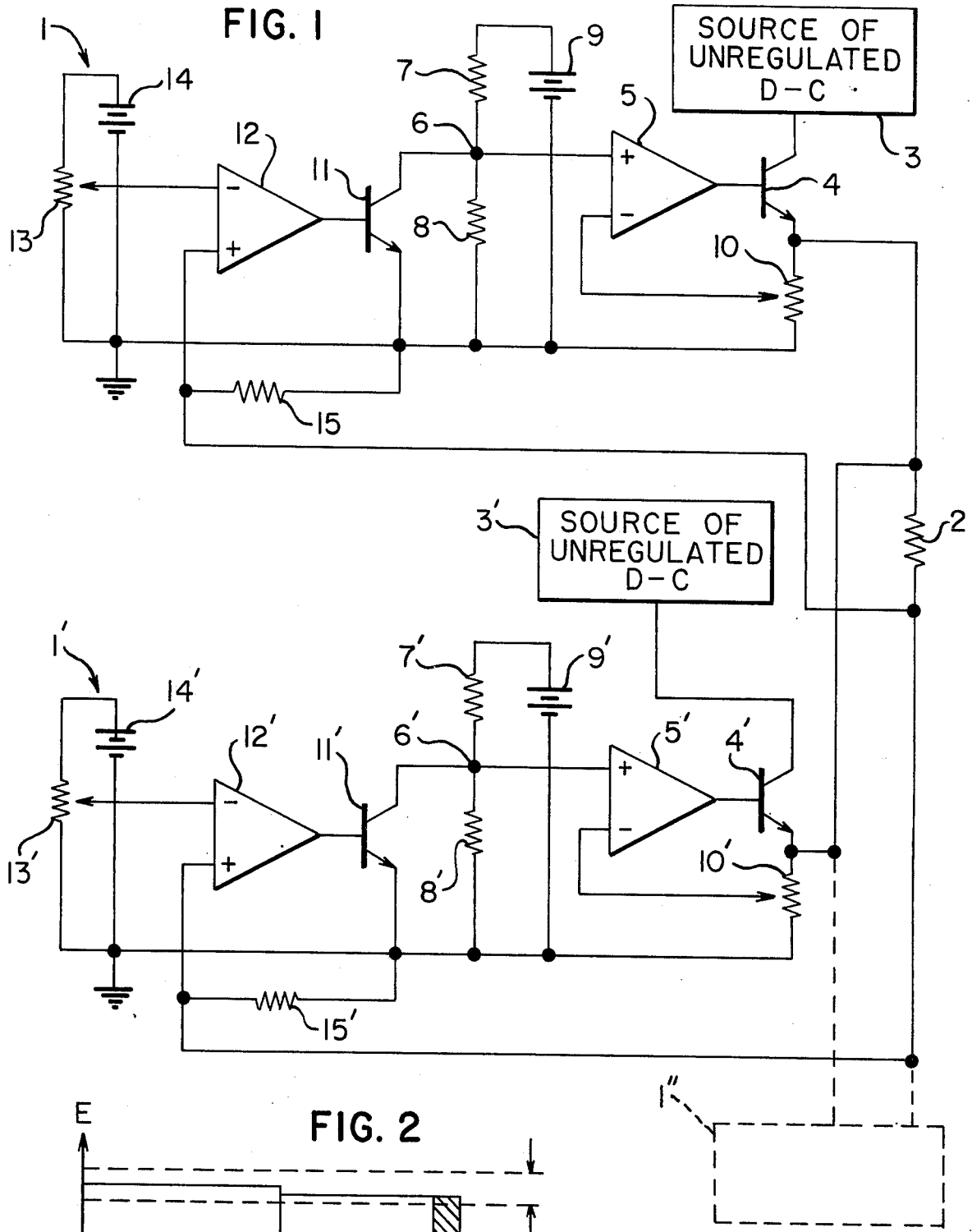
Figure 2:
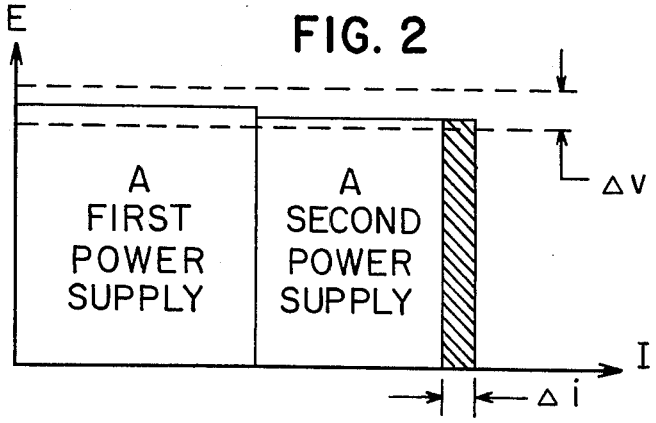

The manner in which these and other objects of the invention are achieved will become readily apparent to those skilled in the art from a consideration of the following specification, taken in conjunction with the subjoined claims and the drawing of which:

FIG. 1 is a schematic diagram of a power supply system employing a plurality of power supplies according to our invention; and FIG. 2 is a current/voltage diagram illustrating the load distribution and operating characteristics of an exemplary two power supply system employing the principles of our invention. Referring now to FIG. 1, it will be observed that a pair of power supplies 1 and 1' deliver power to a load represented by a resistor 2. Each of the power supplies 1 and 1' includes a source 3, 3' of unregulated d-c power and a regulating transistor 4, 4' coupled in series with the load 2. The voltage drops across the regulating transistors 4, 4' are determined by the signal voltages appearing at their respective base electrodes. These signal voltages are received from the output terminals of differential amplifiers 5, 5', and the magnitude of each signal voltage is determined by the differences, if any, between the voltages observed at the respective input terminals of the differential amplifiers 5, 5'.

The positive input terminals of the differential amplifiers 5, 5' are connected to the junctions 6, 6' between resistors 7 and 8 and resistors 7' and 8', respectively. The resistors 7 and 8 and the resistors 7' and 8' are connected between stable voltage sources, represented by the batteries 9 and 9', and ground potential such that the positive input terminals of the differential amplifiers 5, 5' normally observe a reference voltage predetermined by the stable voltage sources 9, 9' and the resistance ratios of the resistors 7, 8 and 7', 8'.

Feedback signals applied to the negative input terminals of the differential amplifiers 5, 5' are taken from the top of variable resistors 10, 10' which are connected between the power supply system output to the load 2 and ground.

Those skilled in the art will recognize that the discussion to this point has described a rather conventional constant voltage regulated power supply in which the output voltage is determined by the adjustment of the variable resistor 10.

Consider now the additional circuitry by which the ability to dispose a plurality of identical power supplies in parallel is achieved. It will be noted that the resistors 8, 8' are shunted by transistors 11, 11' which function as electronically variable resistors when turned on. The base electrodes of the shunt transistors 11, 11' are respectively connected to the output terminals of differential amplifiers 12, 12'. Current reference potentials are developed at the tops of variable resistors 13, 13' which are connected between second stable voltage sources, represented by batteries 14, 14', and ground potential. The current reference potentials are applied to the negative input terminals of differential amplifiers 12, 12'.

Current sensing resistors 15, 15' are each connected in series with the load 2 between the load and ground. These current sensing resistors are preferably low ohmic units such that potentials developed across them are representative of the load current and may be utilized as current feedback signals. The current feedback signals developed across current sensing resistors 15, 15' are applied to the positive input terminals of the differential amplifiers 12, 12', respectively. Thus, it will be understood that the load current value which will cause the differential amplifiers 12, 12' to issue positive signals to the base electrodes of the shunt transistors 11, 11' is determined by the adjustment of variable resistors 13, 13'.

The operation of the two power supplies 1, 1' operating in parallel to provide power to the load 2 may best be understood by considering FIG. 2 as well as FIG. 1. In FIG. 2, the range $\Delta v$ represents acceptable design tolerance for a given application. For example, a common tolerance range specified for data processing equipment is 5.0 volts ±2% or 4.9 to 5.1 volts.

The two power supplies 1, 1' are individually adjusted, to nominal constant voltage operation which may be, merely by way of example, 5.0 volts by appropriate manipulation of the variable resistors 10, 10'. Similarly, the two power supplies 1,1' are individually adjusted to an appropriate maximum current output which may be, for example, 10 amperes in a system in which the total current demand is expected to fall between 10 and 20 amperes.

As a practical matter, any two such supplies will have slightly different characteristics albeit each is well within tolerance. Assume, for example, that power supply 1 actually regulates to 4.95 volts while power supply 1' regulates to 4.98 volts. When these two power supplies are placed in parallel to drive the load 2, supply 1' will initially attempt to carry the full load since it is regulating to a slightly higher voltage. However, as soon as the current through current sensing resistor 15' reaches a nominal value of 10 amperes (the actual value need only be within the maximum current tolerance range), differential amplifier 12' will issue a positive signal to the base electrode of shunt transistor 11' which begins to conduct, thereby altering the voltage divider normally comprising the resistors 7' and 8' by effectively decreasing the resistance value of the resistor 8'. As a result, the reference voltage appearing at the positive input terminal of differential amplifier 5' will drop slightly such that the bias on the series regulator 4' will be reduced to lower the regulated voltage output of the power supply 1'. In effect, the power supply 1' will shift to a constant current mode of operation.

When the regulated voltage to the load 2 drops to 4.95 volts, the power supply 1, which had previously been carrying none of the load, picks up the current load in excess of 10 amperes and commences operation in the constant voltage mode. Variations in load current, such as that represented by the shaded portion of FIG. 2, are absorbed by the power supply 1.

It is possible that, during normal operation, two power supplies operating in parallel will each change characteristics slightly while still remaining within tolerance. Such changes might be attributable, for example, to the effect of temperature change on the circuit components. If such drift in characteristics should result in the power supply previously regulating to the lower voltage to begin regulating to the higher voltage, it will simply shift into the constant current mode, and the other power supply will assume the constant voltage mode.

Additional identical power supplies, such as the power supply 1'' of FIG. 1, can be placed in parallel with the power supplies 1 and 1'. It will be seen, in such an array, that only the one power supply regulating to the lowest voltage at a given time will operate in the constant voltage mode; all the rest will operate in the constant current mode at the nominal maximum current level.

While the principles of our invention have been made clear in the foregoing description of an exemplary embodiment, it will be obvious to those skilled in the art that various modifications may be made to accommodate specific operating requirements and environments. The appended claims are intended to cover and embrace any such modifications within the limits only of the true spirit and scope of the invention.

We claim:

1. A regulated d-c power supply adapted to operate in parallel with one or more additional power supplies schematically identical thereto to provide voltage regulated direct current to a single load comprising:

A. a source of unregulated d-c;

B. regulating transistor means disposed in series between said source and the load;

C. a first differential amplifier having an output terminal coupled to said regulating transistor means for controlling the conduction thereof, said first differential amplifier further including first and second input terminals;

D. means for setting up a first reference potential;

E. means coupling said first reference potential to said first input terminal of said first differential amplifier;

F. voltage sensing means for developing a load voltage signal which constitutes a potential proportional to the voltage applied to the load;

G. means coupling said load voltage signal to said second input terminal of said first differential amplifier;

H. a second differential amplifier having an output terminal and first and second input terminals;

I. means for setting up a second reference potential;

J. current sensing means for developing a load current signal which constitutes a potential proportional to the current provided to the load by said power supply;

K. means coupling said second reference potential to said first input terminal of said second differential amplifier;

L. means coupling said load current signal to said second input terminal of said second differential amplifier; and M. variable impedance means coupled between said output terminal of said second differential amplifier and said means for setting up a first reference potential for effecting modification to said first reference potential in response to a change in an output signal from said second differential amplifier.

2. The regulated d-c power supply of claim 1 in which said means for setting up a first reference potential includes a first voltage divider of at least two resistance means and in which said variable impedance means comprises a transistor driven by said second differential amplifier and disposed in shunt with at least one of the said resistance means comprising said first voltage divider.

3. The regulated d-c power supply of claim 2 in which said means for setting up a second reference potential includes a second voltage divider by which the load current value causing said second differential amplifier to commence driving said transistor may be adjusted.

4. The regulated d-c power supply of claim 3 in which said second voltage divider comprises a variable resistor.

5. The regulated d-c power supply of claim 4 in which said voltage sensing means includes a variable resistor having a tap connected to said second input terminal of said first differential amplifier whereby the nominal voltage applied to the load by said power supply may be adjusted.

* * * * *